United States Patent [19]

Piotrovsky

[11] Patent Number: 4,747,028

[45] Date of Patent: May 24, 1988

[54] LOW-MAINTENANCE, LOW-GLARE LUMINAIRE

[75] Inventor: Alfred G. Piotrovsky, New Hyde Park, N.Y.

[73] Assignee: Metropolitan Life Insurance Company, New York, N.Y.

[21] Appl. No.: 56,258

[22] Filed: May 26, 1987

Related U.S. Application Data

[63] Continuation of Ser. No. 813,685, Dec. 27, 1985, abandoned.

[51] Int. Cl.[4] ..... F21V 5/02

[52] U.S. Cl. ..... 362/224; 362/355

[58] Field of Search ..... 362/224, 150, 385, 290, 362/342, 408, 148, 330, 260, 362, 364, 367, 311, 300, 390, 280, 279

[56] References Cited

U.S. PATENT DOCUMENTS

| | | | |
|---|---|---|---|
| 2,971,083 | 2/1961 | Phillips et al. | 362/342 |
| 3,093,323 | 6/1963 | Guth, Jr. | 362/330 |
| 3,129,895 | 4/1964 | Franck | 362/330 |
| 3,130,922 | 4/1964 | Smith | 362/148 |
| 3,140,833 | 7/1964 | Woloski | 362/330 |
| 3,264,470 | 8/1966 | Bodian | 362/355 |
| 3,336,471 | 8/1967 | Milner | 362/355 |
| 3,358,138 | 12/1967 | Trantina | 362/355 |
| 3,988,609 | 10/1976 | Lewin | 362/217 |
| 4,242,723 | 12/1980 | Fabbri et al. | 362/224 |
| 4,488,208 | 12/1984 | Miller | 362/223 |

*Primary Examiner*—Raymond A. Nelli

*Attorney, Agent, or Firm*—Kenyon & Kenyon

[57] ABSTRACT

The present invention relates to the field of luminaires, and more specifically relates to the field of luminaires employing means to provide even, glare-free illumination.

21 Claims, 2 Drawing Sheets

LOW-MAINTENANCE, LOW-GLARE LUMINAIRE

This is a continuation of co-pending application Ser. No. 813,685 filed on Dec. 27, 1985, now abandoned.

BACKGROUND OF THE INVENTION

1. Field of the Invention

The present invention relates to the field of luminaires, and more specifically relates to the field of luminaires employing means to provide even, glare-free illumination.

2. Description of the Prior Art

The problem of reducing the harshness of lighting emanating from lighting fixtures is one with which the art has been struggling for many years. Early solutions included diffusers, i.e. translucent sheets placed between the light source and the area external to the lighting fixture in order to reduce glare and to provide more even, softer lighting. Examples of such devices are the commonly-seen frosted glass portions of light fixtures. Also, Wilson, in U.S. Pat. No. 3,460,299 which issued on Aug. 12, 1969, proposed a ceiling made up of opalescent plastic panels with a double thickness to provide both illumination and sound deadening.

A solution widely adopted by the art has been to provide a cellular structure beneath the light source to diffuse the illumination. As originally proposed, such structures featured a simple gridwork, also referred to as the "egg crate" design, as seen in U.S. Pat. No. 2,607,455 which issued on Aug. 19, 1952.

Adaptations of such structures provided the gridwork in a curved form, as in U.S. Pat. No. 2,837,632 which issued on June 3, 1958 to Lipscomb. A later development was the introduction of curved sides for the gridwork members as in U.S. Pat. Nos. 4,272,804 which issued on June 9, 1981 to Blum and 2,971,083 which issued on Feb. 7, 1961 to Phillips. Such curved sides result in multiple reflection of light rays directed away from the vertical which provides even illumination below the luminaire.

Generally, the gridwork is provided with both the top and bottom surfaces open in order to give the maximum transmission of light; however, some constructions provide for a diffuser surface simply above the grid work. For example, Jones, in U.S. Pat. No. 3,996,458 which issued on Dec. 7, 1976, Cutler, in U.S. Pat. No. 3,152,277 which issued on Oct. 6, 1964 and Schwartz, U.S. Pat. No. 3,922,073 which issued on Nov. 25, 1975, disclose various embodiments of a cellular diffusing structure which is combined with a planar diffuser closing the upper ends of the cells. Although many permutations and combinations of these ideas have been proposed including various shapes for the cells and various materials for the structure, the art has found no utility to be gained through closing the lower ends of the cells.

The increased use of microcomputers in the business environment has led to an increased awareness of the advantages of cellular luminaire design. It has been found that the lighting pattern produced by conventional, non-cellular illumination fixtures presents a significant reflected glare problem on the screen of the cathode ray tube of a computer terminal or a word processor. Although some installations employ "filter" screens of dark-colored, fine mesh to reduce reflected glare from the screen, such "filters" substantially reduce the light level of the images on the screen. Another approach has been to install cellular luminaires. Not only is improvement seen in general lighting through this approach, but also glare is significantly reduced, concomitantly reducing worker fatigue, headaches, and eye strain. The most efficient cellular structures for reducing such glare have been found to employ relatively small cell sizes, for example, in the range of ¼ inch to 1½ inches.

A serious problem that has not been addressed by the art, however, is that of maintaining cellular luminaire structures after installation. In the typical open-ended construction, large volumes of air flow through the luminaire, driven by the convection currents set up by the heat of the lighting elements such as fluorescent lamps. Even when the upper ends of the cellular structure is closed off by a diffuser sheet overlying the cellular structure, the heating of the cellular structure by the lamps causes appreciable air flows around the bottom surface and the cells. As a result, dust becomes steadily accumulated on the surfaces of the cellular structure. Over a relatively short period of time, the dust build-up appreciably degrades the ability of the cell walls to reflect light, reducing the overall illumination provided by the fixture. In addition, the accumulation of dust is unsightly. In order to remove such build up, a significant maintenance effort is required to clean the cell walls. The magnitude of this effort can be appreciated by considering the work involved in cleaning a luminaire measuring 2×4 feet, which, assuming a widely-used cell size of 1 inch by 1 inch, involves the cleaning of 1,152 sets of cell walls. Moreover, the small size of such cells exacerbates the problem, requiring laborious hand work to remove dust and grime. Typically such cleaning operations require large tubs or vats in which the cellular structure is submerged for washing and rinsing. Thereafter, the cellular structures must be dried, polished, etc. To date, the prior art offers no solution to this problem, No devices, whether on the market or discussed in U.S. patents or other references, combine the lighting advantages of the cellular luminaire with ease of maintenance.

SUMMARY OF THE INVENTION

It is an object of the invention to provide a luminaire with a cellular structure which reduces glare.

It is another object of the invention to provide a luminaire which prevents the accumulation of dust within the cellular structure.

It is an additional object of the invention to provide a luminaire with a cellular structure which can easily be cleaned.

A further object of the invention is to provide a luminaire which can be cleaned of accumulated dust without requiring removal of the cellular structure from the lighting fixture.

These and other objects are accomplished in the invention. The luminaire of the invention includes a housing, with a top portion and side walls forming a downwardly facing opening, and a light source, preferably flourescent lighting tubes with conventional mountings and wiring connections. At the lower or bottom portion of the housing a louver extends across the opening of the housing with a plurality of open cells extending through the louver between the light source and the area outside the fixture.

In a preferred embodiment of the invention, the walls of the open cells are curved, reflective surfaces designed to facilitate the transmission of light in an even pattern to the area below the fixture. Extending completely across the louver is a sheet of translucent material, preferably hermetically sealed to the louver. The sheet can be formed of any material possessing the property of good light transmittance, and in one embodiment is a clear resin. In another embodiment, the sheet is formed of an opalescent material. In still another embodiment, the sheet can be grooved on the bottom surface thereof to interrupt the surface and minimize reflections thereon. The effect of this sheet is to prevent the entry of airborne dust into the cells in the louver, thereby precluding the build up of dust and dirt that requires serious maintenance efforts to remove.

It is preferred to add a second or top sheet of translucent material, hermetically sealed to the top surface of the louver, thus insuring that no dust, from whatever direction, can be deposited on the louver walls. This top sheet can be either a transparent or an opalescent material.

An advantage of the present invention can be envisioned by considering the maintenance effort required to clean the louver of a luminaire according to the invention as compared to that required to clean a louver of a luminaire of the prior art. Thus, the louver of the invention can be cleaned simply by wiping the flat bottom surface of the sheet of translucent material, thereby rapidly removing any dust thereon. In contrast, the prior art devices all require the expenditure of considerable and tedious labor in order to remove dust build up on the surfaces of each of the cells of the louver. Clearly, the present invention solves a major problem that had neither been addressed nor overcome by the prior art.

DETAILED DESCRIPTION OF PREFERRED EMBODIMENTS

Figure 1:
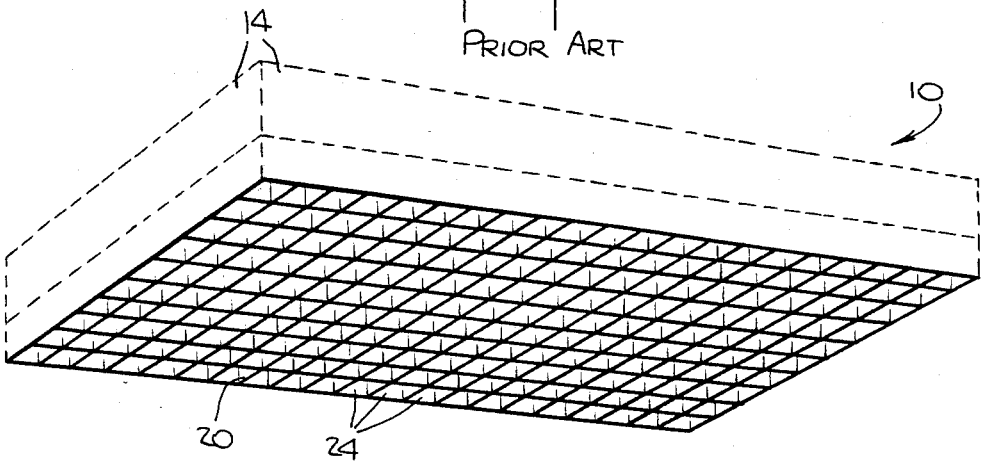
Fig. 1. PRIOR ART
FIG. 1 is a perspective view of a typical prior art luminaire having a cellular louver.
Figure 2:
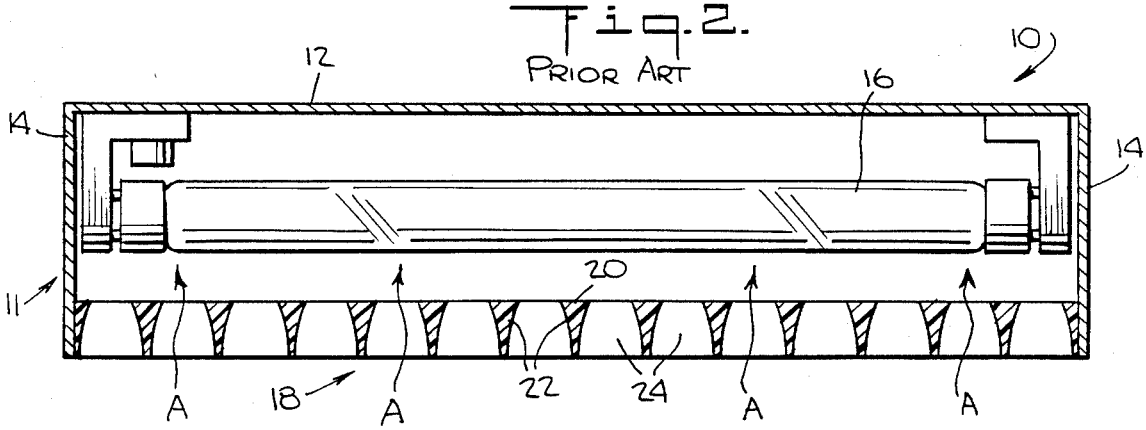
Fig. 2. PRIOR ART
FIG. 2 is a vertical section of the prior art device shown in FIG. 1.

A typical luminaire 10 of the prior art is shown in FIGS. 1 and 2. Normally, the body of the luminaire is recessed into, for example, a ceiling as shown. The body portion 11 of the device includes top portion 12 and side walls 14 which are joined to form an open box-like structure with its open end projecting downwardly from the ceiling. Lighting elements 16 are carried within the structure. Such elements preferably include fluorescent lighting elements, mountings, ballasts, and wiring connections which are known in the art.

A louver assembly 18 is carried in the open portion of the body portion 11 and is mounted with the lower edge of the louver generally flush with the lower edges of the side walls, and thus also flush with the ceiling. The louver assembly comprises wall elements 20 which are arranged in a rectangular, intersecting pattern to define a multiplicity of cells 24. The wall elements 22 are elongated, curved surfaces, generally cylindrical in form with a cross-section corresponding to that of a parabola whose apex lies in the general vicinity of the lighting element. It should also be noted that the top and bottom of the louver are open, thereby permitting air to flow upwardly through the louver as shown by arrows A. The dimensions of the entire luminaire may be, for example, from about 1 foot×2 feet to 2 feet×4 feet, and the cell size may range from about ½ inch to about 1½ inches. It known to arrange cells in a variety of shapes, such as round or hexagonal forms.

Figure 3:
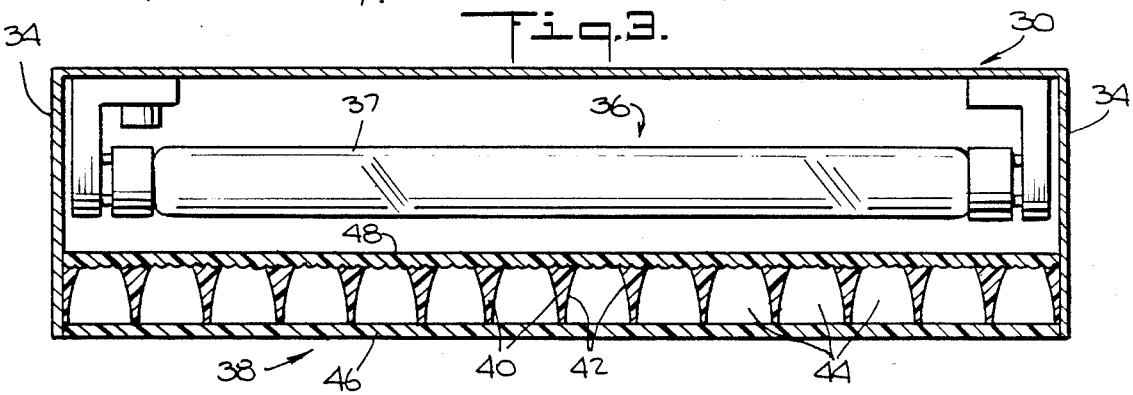
FIG. 3 is a vertical section of a preferred embodiment of the louver of the invention.
Figure 4:
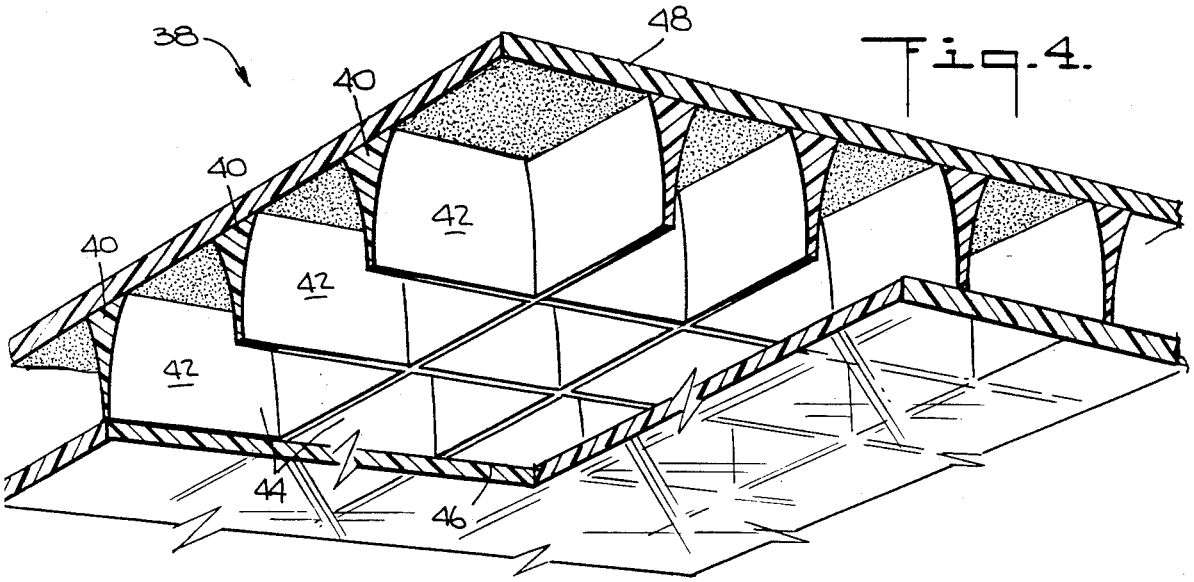
FIG. 4 is a fragmentary perspective view of the embodiment of the louver of the invention shown in FIG. 3, cut away to show the cellular elements thereof.

A luminaire 30 constructed according to the present invention is shown in FIG. 3. The body of this luminaire can be constructed as is known to the art, including a top plate 32, side walls 34 and a lighting assembly 36. Preferably, the lighting assembly includes one or more fluorescent tubes 37. The louver assembly, carried in the lower portion of the body is shown in detail in FIG. 4. As is true of the conventional luminaire, a multiplicity of wall elements 40 are arranged in an intersecting pattern to form cells 44. The inner surfaces of the walls of each cell are curved, preferably a cylindrical surface having a cross-section in the form of a parabola. Bottom plate 46 and top plate 48 are bonded to the lower and the upper surfaces of the louver, respectively, in sandwiched relation in order to seal the individual cells. The plates can be formed of resin material which has good light transmission properties. In the embodiment shown in FIGS. 3 and 4, the plates are preferably transparent. In other embodiments, the plates can be formed of resin material in a variety of pigmented tints as well or with an opalescent property.

Wall elements 40 can be formed of any convenient material, preferably of metallized resin material. The metallized surface of these elements should be highly reflective.

As can be seen in FIG. 3, maintenance of a luminaire in accordance with the invention is extremely simple to perform. Instead of laboriously and tediously cleaning the surfaces of each individual cell to remove accumulate dust and film, it is sufficient simply to wipe or wash the exposed portions of the bottom and top plates to restore them to a like-new condition. Accordingly, there is no need to remove the louver for washing in a tub or vat. Thus, when the louver is pivotally mounted, it is only necessary to swing the louver to a vertical position to expose both plates for cleaning.

Figure 5:
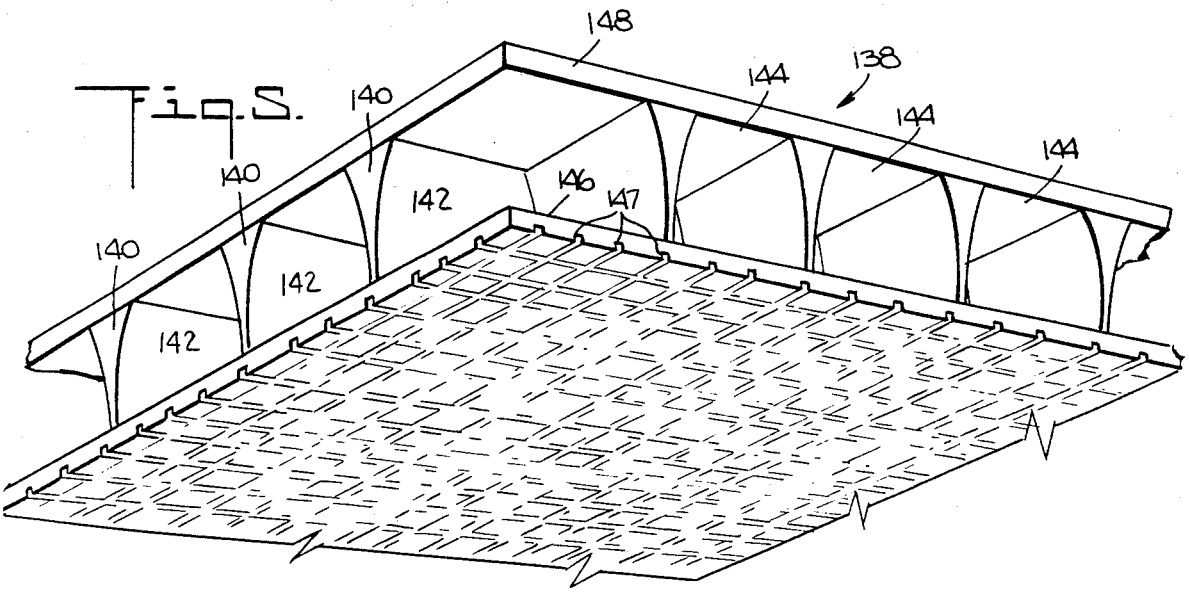
FIG. 5 is a fragmentary perspective view of a second embodiment of the invention.

An alternate embodiment of the invention incorporating a second form of louver 138 is shown in FIG. 5. The remainder of the construction of this embodiment corresponds to that discussed above. Also, the louver wall elements 140 and the top plate 148 correspond to the elements discussed above. Here, however, the bottom plate 146 differs in that a pattern of grooves 147 is formed in a grid-like array on the bottom surface of the bottom plate. Although these grooves preferably are formed in a grid-like pattern, other patterns of intersecting lines can be employed. This luminaire due to the grooves not only offers ease of maintenance, but also presents a pleasing aesthetic appearance. In addition, since the grooves interrupt the lower surface on the bottom plate of the bottom plate, the grooves minimize the tendency of the lower bottom surface of the bottom plate to act as a mirror. If it is desired to increase the diffusion and dispersion of the light, top plate 148 can be formed of opalescent material or be provided with a grained or roughened surface.

Figure 6:
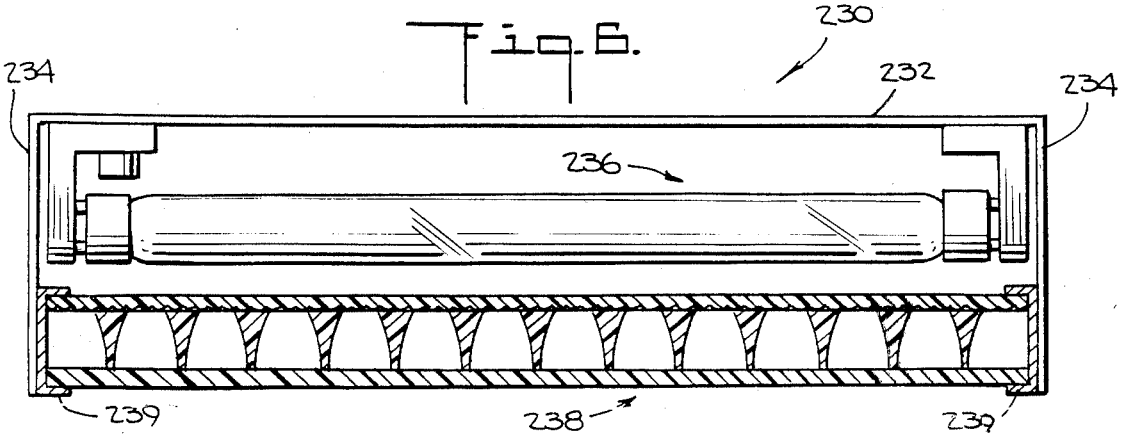
FIG. 6 is a vertical section of a third embodiment of the invention.

A further embodiment 230 of the invention is shown in FIG. 6. Upper portion 232, side walls 234, and lighting assembly 236 correspond to elements described above. The interior construction of louver 238 corresponds to the louver assemblies previously described; however, an edging 239 is provided around the sides of the louver to create an attractive decorative appearance. The edging can be formed of a material which will prove attractive in an office environment and generally is formed in the shape of the letter "C", completely enclosing the edges of the louver.

Figure 7:
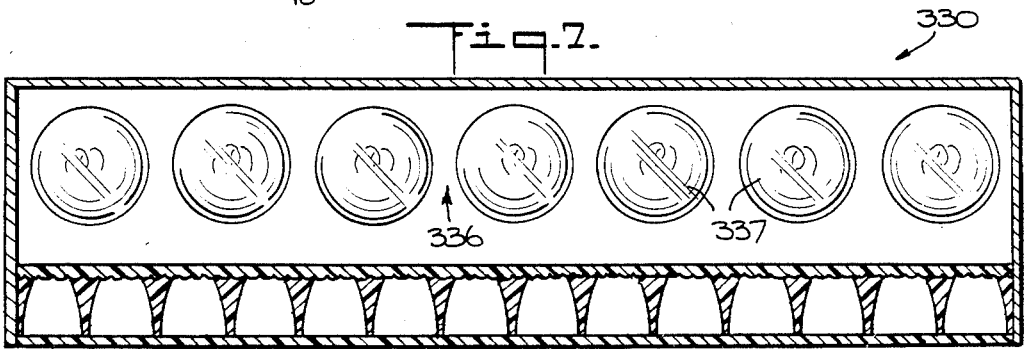
FIG. 7 is a vertical section view of a fourth embodiment of the invention.

The embodiments described above show the use of fluorescent lighting elements. In some circumstances, however, incandescent lighting is preferred. In the lamp fixture 330 shown in FIG. 7, lighting assembly 336 includes a plurality of incandescent lamps 337, conventionally mounted in the luminaire body as is known to the art. The number and size of the incandescent lamps can be chosen to provide the desired lighting level.

It should be understood that various modifications and adaptations can be made to luminaires produced in accordance with the invention. For example, a variety of different lighting assemblies can be employed. In addition, the assemblies can be adapted to be mounted on a wall rather than in or on a ceiling. These and other modifications will be apparent to those of skill in the art and can be made without departing from the scope of this invention which is defined solely by the claims appended hereto.

What is claimed is:

1. A lighting fixture comprising an open housing with a base portion and a side wall portion extending outwardly from said base portion adjacent the periphery thereof to form an exposed interior portion of said housing;

a source of light disposed within said interior portion of said housing;

a cellular louver mounted on said side wall portion of said housing and extending across said exposed interior portion therein, said cellular louver containing an array of a plurality of openings extending substantially parallel to one another for directing light from said light to outside the fixture; and a pair of sheets of translucent material secured to opposite sides of said louver in sandwiched relation and overlying the openings therein to prevent the entry of dust into the openings in the cellular louver.

2. A lighting fixture in accordance with claim 1 in which each sheet of translucent material is sealed with respect to the side of said louver adjacent thereto.

3. A lighting fixture in accordance with claim 2 in which a portion of the surface of each sheet of translucent material is sealed to said louver.

4. A lighting fixture in accordance with claim 2 in which the periphery of each sheet of translucent material is sealed to said periphery of said louver.

5. A lighting fixture in accordance with claim 1 in which the surface of one sheet of translucent material facing away from said louver is conditioned to reduce reflections thereon.

6. A lighting fixture in accordance with claim 5 in which said surface of said one sheet is conditioned with a plurality of grooves extending along said surface to reduce reflections thereon.

7. A lighting fixture in accordance with claim 6 in which said grooves intersect one another.

8. A lighting fixture in accordance with claim 7 in which said intersecting grooves are substantially grid-like in form.

9. A lighting fixture in accordance with claim 1 in which each of said plurality of openings in said louver is formed by a wall portion facing the opening, said wall portion of each opening having a section extending in a direction toward said opening having a section extending in a direction toward said base portion of said housing, said section being curved outwardly away from said base portion for reflecting light from said source of light outwardly from said louver.

10. A lighting fixture in accordance with claim 9 in which said curved section of each opening is in the form of a parabola having its focus adjacent said source of light.

11. A lighting fixture in accordance with claim 9 in which said surface of said wall portion of each of said plurality of openings is reflective.

12. A lighting fixture in accordance with claim 1 in which one sheet of translucent material comprises material for diffusing light passing therethrough.

13. A lighting fixture in accordance with claim 1 in which the sheet of translucent material remote from said light source is transparent.

14. A lighting fixture in accordance with claim 1 in which at least one surface of the sheet of translucent material remote from said light source is textured to diffuse light pass therethrough.

15. A cellular louver for a lighting fixture having an open housing with a base portion and a side wall portion extending outwardly from the base portion adjacent the periphery thereof to form an exposed interior portion of the housing, and a source of light disposed within the interior portion of the housing;

said cellular louver comprising a cellular structure adapted to be mounted on the side wall portion of the housing and extending across the exposed inner portion therein, said structure containing an array of a plurality of openings extending substantially parallel to one another for directing light from the source disposed within the interior portion of the housing to outside the fixture; and a pair of sheets of translucent material secured to opposite sides of said cellular structure in sandwiched relation and overlying the openings therein to prevent the entry of dust into the openings in said cellular structure.

16. A louver in accordance with claim 15 in which each sheet of translucent material is sealed with respect to the side of said cellular structure adjacent thereto.

17. A louver in accordance with claim 15 in which the surface of one sheet facing away from said cellular structure is conditioned with a plurality of grooves extending along said surface to reduce reflections thereon.

18. A louver in accordance with claim 17 in which said grooves intersect one another.

19. A louver in accordance with claim 15 in which each of said plurality of openings in said cellular structure is formed by a wall portion facing the opening, said wall portion of each opening having a section adapted to extending in a direction toward the base portion of the housing, said section being curved outwardly away from the base portion of the lighting fixture when the louver is mounted thereon for reflecting light from the source of light of the lighting fixture outwardly from the louver.

20. A louver in accordance with claim 19 in which said curved section of each opening said cellular structure is in the form of a parabola having its focus adjacent the source of light when said louver is mounted on the lighting fixture.

21. A louver in accordance with claim 19 in which said surface of said wall portion of reach of the plurality of openings is reflective.

* * * * *

UNITED STATES PATENT AND TRADEMARK OFFICE

CERTIFICATE OF CORRECTION

PATENT NO. : 4,747,028

DATED : May 24, 1988

INVENTOR(S) : Alfred G. Piotrovsky

It is certified that error appears in the above-identified patent and that said Letters Patent is hereby corrected as shown below:

Column 6, line 31, delete "pass" and insert --passing--;

Column 7, line 5, delete "opening said" and insert --opening in said--;

Column 8, line 4, delete "reach" and insert --each--;

Signed and Sealed this

First Day of November, 1988

*Attest:*

*Attesting Officer*

DONALD J. QUIGG

*Commissioner of Patents and Trademarks*